US005496139A

United States Patent [19]

Ghode et al.

[11] Patent Number: 5,496,139

[45] Date of Patent: Mar. 5, 1996

[54] COLLET LOCK ARRANGEMENT FOR POWER TOOL

[75] Inventors: Anil P. Ghode, Libertyville, Ill.; Martin S. Scolaro, Racine, Wis.; Gordon A. Putney, Lake Geneva, Wis.; Steven R. Wente, Kenosha, Wis.

[73] Assignee: Snap-on Incorporated, Kenosha, Wis.

[21] Appl. No.: 308,678

[22] Filed: Sep. 19, 1994

[51] Int. Cl.[6] ..... B25F 5/00; G05G 5/06

[52] U.S. Cl. ..... 409/182; 74/527; 188/69; 279/125; 279/158; 408/241 R; 408/710

[58] Field of Search ..... 74/527; 188/69; 279/150, 158, 125; 408/4, 241 R, 710; 144/134 D, 136 C; 451/344, 353, 358, 359; 409/182

[56] References Cited

U.S. PATENT DOCUMENTS

| | | | |
|---|---|---|---|
| 3,044,091 | 7/1962 | Nishihama | 188/69 |
| 3,334,448 | 8/1967 | Alexander | 451/359 |
| 3,679,244 | 7/1972 | Reddy | 403/109 |
| 3,802,518 | 4/1974 | Albert | 173/29 |
| 3,872,951 | 5/1975 | Hastings, Jr. | 188/69 |
| 4,078,589 | 3/1978 | Miller | 144/32 R |
| 4,400,995 | 8/1983 | Palm | 74/527 |
| 4,467,896 | 8/1984 | Sauerwein et al. | 188/69 |
| 4,489,525 | 12/1984 | Heck | 451/344 |
| 4,503,728 | 3/1985 | Fischer et al. | 74/527 |
| 4,527,680 | 7/1985 | Sato | 188/69 |
| 4,690,252 | 9/1987 | Kottke et al. | 188/69 |
| 4,754,669 | 7/1988 | Verdier et al. | 81/57.14 |
| 5,016,501 | 5/1991 | Holzer, Jr. | 81/57.11 |
| 5,191,968 | 3/1993 | McCurry | 409/182 |

*Primary Examiner*—Steven C. Bishop
*Attorney, Agent, or Firm*—Emrich & Dithmar

[57] ABSTRACT

An improved collet lock arrangement for a hand-held power tool having a housing is provided. The collet lock arrangement includes a powered rotatable shaft including a base portion and distal end portion defining a collet for adaptably connecting a driver tool attachment thereto and a locking structure for securely locking the shaft to the housing to selectively prevent the shaft from rotating when in a locked position while allowing the shaft to freely rotate in an unlocked position. The locking structure has a locking sleeve coaxially coupled around the shaft for axial movement relative thereto between the locked and unlocked positions, a clamp nut fixedly connected to the housing, and a sleeve guide non-rotatably coupling the locking sleeve to the clamp nut. The clamp nut and sleeve guide are coaxially arranged for coaxially receiving therethrough the shaft and the locking sleeve. During axial movement of the locking sleeve from the unlocked position to the locked position, a portion of the locking sleeve is slidably matingly engaged between the base portion of the shaft and the guide to lock the shaft against rotational movement.

16 Claims, 2 Drawing Sheets

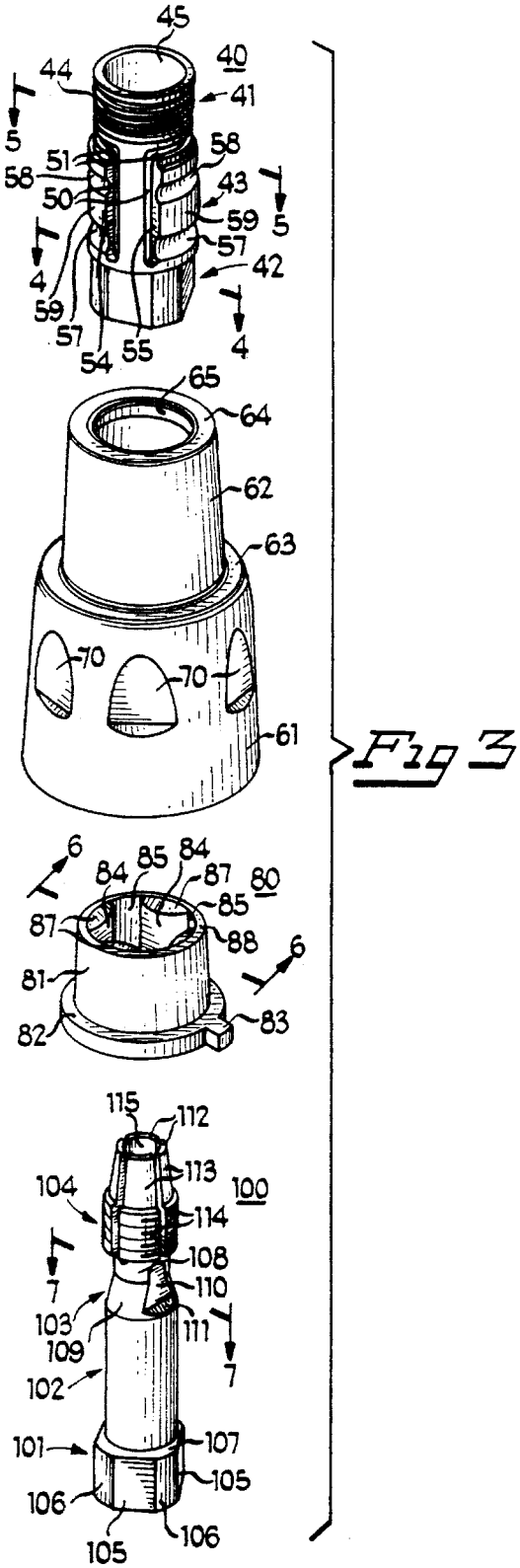
Fig 3
Fig 5
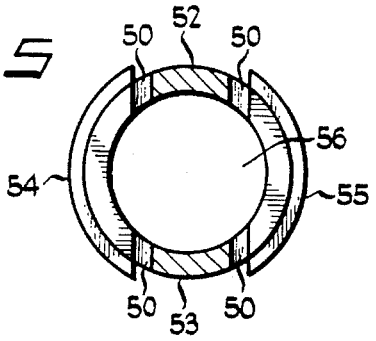
Fig 4
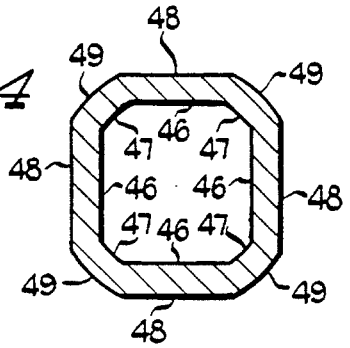
Fig 6
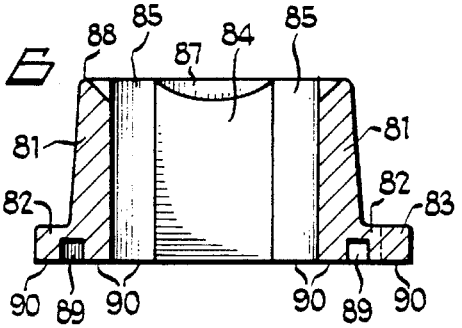
Fig 7
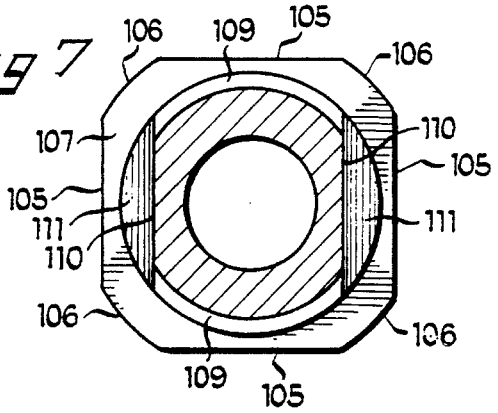

COLLET LOCK ARRANGEMENT FOR POWER TOOL

BACKGROUND OF THE INVENTION

1. Field of the Invention

The present invention relates generally to the field of power tools and, more particularly, to a collet lock arrangement for a power tool of the type receiving interchangeable accessory tools.

2. Description of the Prior Art

Various types of rotating power machinery, particularly with regard to certain types of hand-held power tools, require a user to selectively attach an accessory tool thereto such as a drill-bit or a surface treating disk (for example, a polishing pad, a sanding disk, or a grinder tool). Convenient removal and replacement of interchangeable accessory tools is therefore desirable. A selected accessory tool attaches to an end of a rotatable collet shaft which is mechanically driven by power transmitting components within the power tool. Conventionally, a collet lock is often used to lock the collet shaft against movement during removal and replacement of an accessory tool.

In many portable power tools, including air tools and electric motor-driven tools, a nut is provided to axially secure the accessory tool to the rotatable shaft. When changing accessory tools, the nut must be loosened to allow the shaft to release its grip on the accessory tool. Similarly, when a new accessory tool is added, the nut is tightened (preferably with a wrench or the like) within or about the shaft so as to be rotatably axially driven thereby.

During a removal and/or replacement operation, the collet shaft must be prevented from rotating or else it would be impossible to loosen a tightened nut if the latter is free to rotate freely with the shaft to which it is secured.

During loosening of the nut, an operator connects a first wrench to the secured nut and a second wrench to a wrenching portion along the rotatable shaft. A torque is then applied to the nut by rotating the first wrench in a counterclockwise direction causing the nut to disengage from the rigidly held rotatable shaft.

In the case of portable power tools of substantial weight, the two handed operation described above is a great inconvenience and dangerous. For example, because the operator's two hands are both being put to use in holding the two wrenches, when changing an accessory tool the operator can easily lose his grip on the tool causing the device to fall on the ground or, alternatively, will be unable to create a strong enough torque about the rotatable shaft since the bulk of the torque is unstably counteracted by the great weight of the housing portion of the power tool to which an end of the collet shaft is mechanically connected.

As a result, the two-handed operation described above becomes a three-handed operation, particularly for large, heavy power tools as the operator inevitably is forced to secure the base or housing portion of the power tool in a vise (the third hand) to facilitate the unscrewing of the nut at an opposite end therefrom.

Alternative constructions for securing the accessory tool to the collet shaft other than with a secured nut are also well known. One such construction is a keyless chuck design. While a three-handed operation is unnecessary, a big disadvantage of the keyless chuck is that its use is limited to relatively light-weight portable tools (such as drills which receive interchangeable driver bits) whose mass and shaft rotational speed is small. Portable tools such as die grinder tools characteristically have a high rotational speed (≈20,000 RPM) and are subject to high vibrations. Inevitably therefore, a keyless chuck therewith would become loose over time causing the die grinder bit to fall out or break during use.

SUMMARY OF THE INVENTION

It is a general object of the invention to provide a hand-held power tool with a collet locking structure which is economical and easy to manufacture.

It is another object of the present invention to provide a hand-held power tool with a collet locking structure which allows a user to conveniently remove or replace an interchangeable accessory tool. Because the collet locking structure operates to lock the shaft against rotation in the locked position, the user is saved the inconvenience of having to use a third hand (or a vise) to secure the tool's housing from rotation relative to the shaft. For the same reason, also rendered unnecessary is the use of a second wrench.

It is another object of the invention to provide a collet locking structure which locks shaft rotation relative to a hand-held power tool's housing to make possible manual use of the power tool.

It is another object of the invention to provide a collet locking structure which uses a locking sleeve made of a flexible material to lock the shaft against rotation. In the event the locking sleeve is damaged or worn out, a replacement sleeve can be readily substituted.

These and other features of the invention are attained by providing a hand-held power tool with a collet lock arrangement which collet lock arrangement includes a powered rotatable shaft having a base portion and a distal end portion defining a collet for adaptably connecting a driver tool attachment thereto. Also included is a locking structure for securely locking the shaft to the power tool's housing to selectively prevent the shaft from rotating when in a locked position while allowing the shaft to freely rotate in an unlocked position. The locking structure is provided with a locking sleeve which is coaxially coupled around the shaft for axial movement relative thereto between the locked and unlocked positions. The locking structure also includes a clamp nut fixedly connected to the housing and a sleeve guide non-rotatably coupling the locking sleeve to the clamp nut. The clamp nut and the guide are both provided with an opening for coaxially receiving therethrough the shaft and the locking sleeve. During axial movement of the sleeve from the unlocked position to the locked position, a portion of the sleeve is slidably matingly engaged between the base portion of the shaft and the guide to lock the shaft against rotational movement. It is envisioned that this collet locking arrangement may be implemented on an air-driven power tool, although there is no reason why it may not also have application in an electrically-driven power tool.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

FIG. 3 is an enlarged perspective, exploded view of the collet locking arrangement of FIG. 1;

FIG. 4 is an enlarged horizontal sectional view taken generally along the line 4—4 in FIG. 3.

FIG. 5 is an enlarged view in horizontal section taken along the line 5—5 in FIG. 3;

FIG. 6 is an enlarged vertical sectional view taken generally along the line 6—6 in FIG. 3.

FIG. 7 is an enlarged horizontal sectional view taken generally along the line 7—7 in FIG. 3.

DETAILED DESCRIPTION OF THE PREFERRED EMBODIMENT

Figure 1:
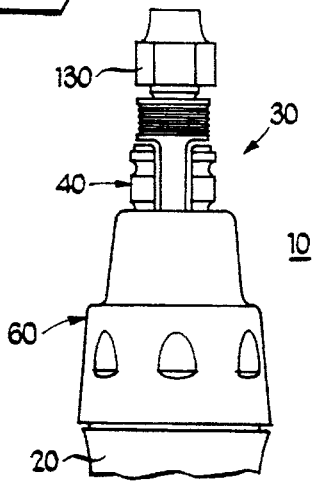
FIG. 1 is a partial side elevation view of a collet locking arrangement of a hand-held power tool constructed in accordance with and embodying the features of the present invention, shown with a locking sleeve set in the unlocked position.
Figure 2:
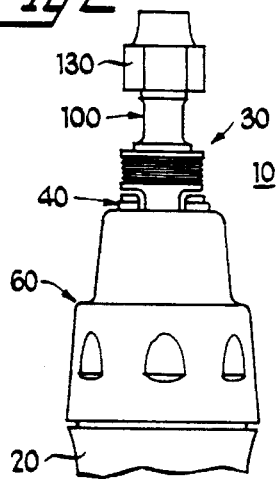
FIG. 2 is a view similar to FIG. 1, but shown with the locking sleeve set in the locked position.

Referring to FIGS. 1 and 2, there is illustrated an upper portion of a hand-held power tool, generally designated by the numeral 10 and including a housing portion 20 and a collet lock arrangement 30, the latter being constructed in accordance with and embodying the features of the present invention.

Housing portion 20 includes an endplate 21, a bearing 22 and a seal 23, all matingly engaged within a cylindrical, partially-threaded, housing wall 24 and cooperating therewith to support a rotor shaft 25. The outer surface of housing wall 24 includes housing threads 26. The construction and operation of motor shaft elements 21–26 are well known in the art of air tools and are shown here only for illustrative purposes to aid in understanding the operation of collet lock arrangement 30 of the present invention.

The collet lock arrangement 30 is of a four-part construction as shown more clearly by the exploded view in FIG. 3 to be described below.

Collet lock arrangement 30 includes a locking sleeve 40, a clamp nut 60, a sleeve guide 80 and a rotatable shaft 100. The four elements recited above cooperate with each other and with housing portion 20 to provide a user of power tool 10 with the ability to set locking sleeve 40 in one of two positions, namely, the unlocked position of FIG. 1, for unlocking the shaft 100 and the locked position of FIG. 2 for locking the shaft 100 against rotation.

Referring now also to FIGS. 4 and 5, the locking sleeve 40 has a substantially cylindrical hollow shape and is characterized by locking sleeve ends 41, 42 and mid-portion 43. More specifically, locking sleeve end 41 is a cylindrical body having a plurality of serrations 44 of fixed depth extending circumferentially around the outer surface thereof. An inner surface of locking sleeve end 41 defines a fixed-diameter cylindrical bore 45 extending the whole axial length thereof. Locking sleeve end 42 is a substantially square-shaped body defined by internal flat surfaces 46 separated by internal arcuate wall surfaces 47 and external flat surfaces 48 separated by external arcuate wall surfaces 49. Opposed ones of the inner surfaces 46 of the locking sleeve end 42 are spaced apart at least the diameter of the cylindrical bore 45 of locking sleeve end 41. A cross-section of locking sleeve end 42 is shown in FIG. 4.

The mid-portion 43 separates locking sleeve ends 41 and 42 and is substantially cylindrical-shaped. Longitudinal slots 50 cooperate with circumferential slots 51 to divide mid-portion 43 into two vertical and diametrically opposed rounded columns 52–53 extending axially between ends 41 and 42, as well as into two flexible walls 54 and 55, also diametrically opposed and integrally axially extending from locking sleeve end 42, the flexibility of which will be explained below. Flexible walls 54, 55, slots 50, 51 and columns 52, 53 cooperate to define an inner cylindrical bore 56 of equal diameter to that of cylindrical bore 45 of locking sleeve end 41. Flexible walls 54 and 55 include two axially spaced-apart grooves 57 and 58 of fixed depth extending circumferentially about the outer surface thereof. A rounded non-grooved surface region 59 separates grooves 57 and 58.

Figure 8:
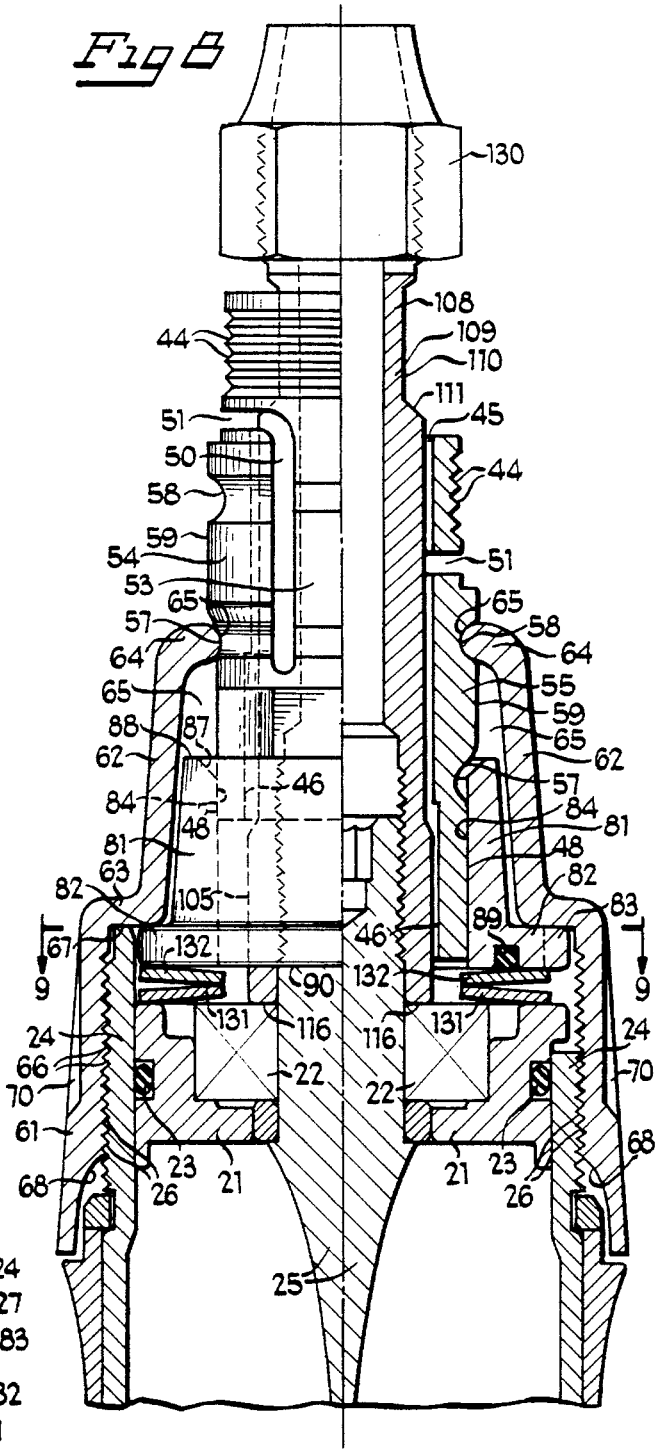
FIG. 8 is an enlarged view in partial vertical section of the collet looking arrangement of FIG. 1 with the unlocked position shown on the left side of and the locked position shown on the right side of the longitudinal midplane.

Clamp nut 60, shown in perspective view in FIG. 3, is of a one-piece, partially dome-shaped construction consisting of a first internally threaded portion 61 and a non-threaded portion 62 separated by a first annular rim 63. Non-threaded portion 62 includes, at an end opposite first annular rim 63, a second annular rim 64 which defines an annular inner surface 65 dimensioned to be received by circular grooves 57 and 58 on flexible walls 54 and 55, as shown in FIG. 8.

Clamp nut 60 is open at both ends to form a hollow cavity therein. Threaded portion 61, shown also more clearly in the breakaway portion of FIG. 8, includes, along an inner diameter thereof, clamp nut threads 66 extending longitudinally from below an inner wall surface 67 of first annular rim 63 to a corner portion 68.

Along the outer rounded surface of threaded portion 61 there are provided flats 70, circumferentially arranged a fixed distance apart specifically provided to act as gripping surfaces and dimensioned to optionally receive either a user's fingertips or a wrench tool.

Referring also to FIG. 6, the sleeve guide 80 consists of a substantially cylindrical body 81 having at a base end thereof an annular flange 82 extending radially outwardly along an outer circumference of body 81. A substantially square-shaped projection 83 extends radially outwardly from annular flange 82. Body 81 is open at both ends. The inner walls of body 81 are dimensioned to engage with the outer wall of the substantially-square shaped body of locking sleeve end 42 and consist of longitudinally extending flat surfaces 84 separated by arcuate wall surfaces 85. Beveled surfaces 87 extend from a top base end 88 of body 81 to the top most edge of flat surfaces 84 forming part-conical surfaces. An annular groove 89 of fixed depth is formed at a base end surface 90 of body 81.

Referring also to FIG. 7, rotatable shaft 100 includes a base portion 101, a cylindrical body portion 102, a wrench gripping portion 103 and a collet portion 104. Base portion 101 is substantially square-shaped and formed by flat walls 105 and arcuate walls 106 and dimensioned to engage the respective internal flat surfaces 46 and internal arcuate surfaces 47 of locking sleeve end 42. Cylindrical body portion 102 extends longitudinally from top surface 107 of base portion 101. Wrench gripping portion 103 extends longitudinally from body portion 102 and consists of a cylindrical body 108, and a frustoconical portion 109. Flat surfaces 110 and 111 are formed at diametrically opposed locations on the gripping portion 103 to provide gripping surfaces for an appropriately sized wrench tool.

Collet portion 104 consists of four longitudinally extending arcuate jaw portions 112 arranged circumferentially but spaced a fixed distance apart. Each jaw portion 112 is connected at a base end thereof to the top surface of wrench gripping portion 103. Each jaw portion includes an angled smooth surface portion 113 and a ridged bottom portion 114. The ridged portions 114 cooperate to provide a threaded post around which a nut 130 is engaged to cause the collet portion 104 to flex inwardly around an interchangeable accessory tool (not shown), the latter having a shaft dimensioned to fit within opening 115 formed by the cooperative relationship of jaw portions 112, all in a known manner.

With the exception of locking sleeve 40, for which a super tough nylon or like material is preferred, all other components may be constructed from metal or like material formed into the shape generally shown in the drawings. It will be appreciated that because of the nylon material of the locking sleeve 40, the walls 54 and 55 resulting from the slots 50 and 51 are flexible and resilient. This facilitates movement of the locking sleeve 40 between its locked and unlocked positions, as explained below.

During initial assembly, rotatable shaft 100 is matingly engaged with the rotor shaft 25 so that a base surface 116 of rotatable shaft 100 rests squarely on the surface of bearing 22 and partially extends within wall 24 of housing portion 20.

Conical washers 131, 132 are seated over endplate 21 in overlapping fashion. Threads 26 of housing wall 24, shown in cutout view in FIG. 8, allow the clamp nut 60 to be threaded (screwed) thereon by way of clamp nut threads 66. First, however, prior to threading engagement of clamp nut 60 and housing wall 24, locking sleeve 40 is separately brought into engagement with the inner walls of sleeve guide 80. Once locking sleeve 40 is so engaged, locking sleeve 40 and sleeve guide 80 are inserted in combination into clamp nut 60 by inserting this combination through the large opening end of clamp nut 60. Once properly engaged, circular groove 57 located on flexible walls 54 and 55 will mate with annular inner surface 65 of non-threaded portion 62 of clamp nut 60, in which position, the top surface areas of annular flange 82 and projection 83 of sleeve guide 80 are brought into contact with the bottom inner wall surface of first annular rim 63 of clamp nut 60. Projection 83 of sleeve guide 80 is engaged with an opening 27, shown more clearly in FIG. 9, formed in wall 24 of housing portion 20, to restrain rotation of sleeve guide 80 relative to housing portion 20.

Thereafter, the combination of locking sleeve 40, clamp nut 60 and sleeve guide 80 are brought into engagement with rotatable shaft 100 and housing portion 20. To do this, the rotatable shaft 100 is inserted into the cylindrical cavity of locking sleeve 40 at the same time clamp nut 60 is engaged with housing portion 20 by tightening (threading) of threaded portion 61 around threads 26 of housing wall 24, and base end surface 90 of sleeve guide 80 is brought into contact with conical washer 132. A tight fit is assured between housing portion components and the collet lock arrangement due to the axially flexing nature of conical washers 131 and 132 and the securely threaded coupling of the clamp nut 60 to the housing wall 24.

Once the power tool 10 is assembled as described above, locking sleeve 40 will reside in one of two possible positions. One such position is shown in FIG. 1 and corresponds to the unlocked position. Referring to the left half of FIG. 8, there is shown the position of locking sleeve 40 relative to clamp nut 60; the latter shown cross-sectionally. Clamp nut 60, locking sleeve 40 and sleeve guide 80 are all coaxially arranged about rotatable shaft 100. Rotatable shaft 100 is connected directly to the drive motor (not shown) of the power tool 10 via rotor shaft 25. In the unlocked position, the rotatable shaft 100 rotates freely within locking sleeve 40 with respect to both the clockwise and counterclockwise directions. As shown, a portion of locking sleeve end 42 rests securely a distance within sleeve guide 80. The remaining portion of locking sleeve end 42 rests above sleeve guide 80 below second annular rim 64 of clamp nut 60. The locking sleeve 40 is restrained in place by the mating engagement of annular inner surface 65 of second annular rim 64 with the circular groove 57 in flexible walls 54 and 55, this engagement inhibiting axial movement of sleeve 40 and maintains same in the unlocked position, at least until a sufficient disengaging force is applied thereto.

As should be readily apparent, because the locking sleeve 40—and more particularly, substantially square-shaped locking sleeve end 42—is not engaged with base portion 101 of rotatable shaft 100 in the unlocked position, locking sleeve 40 does not disturb the normal operation and rotation of the rotatable shaft 100. The rotatable shaft 100 thus rotates freely in both radial directions and locking sleeve 40 is non-functional in the unlocked position.

To engage locking sleeve 40 in the locked position of FIG. 2, the power tool user grasps the portion of locking sleeve end 41 which includes serrations 44 and axially applies a pressure thereon to cause locking sleeve 40 to slide downwardly through sleeve guide 80 toward base portion 101. The flexibility of the walls 54 and 55 of the locking sleeve 40 permits them to be deflected inwardly by the camming action of the surface 65 of the clamp nut 60, thereby facilitating disengagement of the surface 65 from the groove 57 to permit the locking sleeve 40 to be axially moved to its locked position. This locked position of the locking sleeve 40 will now be described in greater detail by reference to the right-half view of FIG. 8 and the cross-sectional view of FIG. 9.

During axial movement of locking sleeve 40 from the unlocked position to the locked position, substantially square-shaped locking sleeve end 42 is brought into mating engagement with the base portion 101 of rotatable shaft 100. During axial movement, the downward axial force applied by the user causes the flexible walls 54, 55 to flex inwardly just enough so that the annular inner surface 65 of clamp nut 60 begins to ride (cam) over the rounded non-grooved surface region 59 separating grooves 57 and 58. As annular inner surface 65 approaches groove 58, sleeve guide 80 causes the substantially square-shaped locking sleeve end 42 —which is coaxially arranged between sleeve guide 80 and rotatable shaft 100—to be brought into mating alignment with base portion 101 of rotatable shaft 100. When annular inner surface 65 engages groove 58 on flexible walls 54, 55, this will serve as an indication to the user that the locking sleeve 40 is now in the locked position and that the rotatable shaft 100 is secured against rotational movement. The engagement of groove 58 with surface 65 inhibits axial movement of sleeve 40 and restrains the sleeve 40 in the locked position, at least until a sufficient disengaging force is applied thereto, which would cause the shaft 100 to unlock and thus rotate freely.

Figure 9:
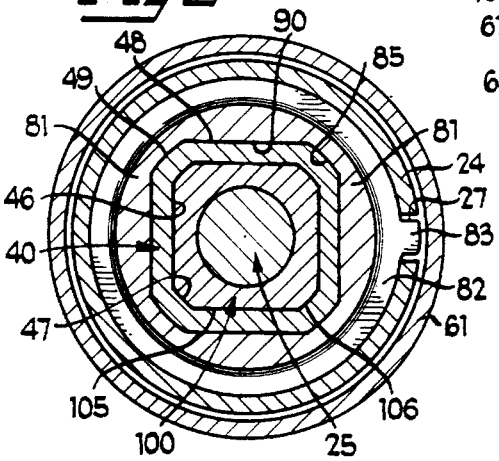
FIG. 9 is a horizontal sectional view taken generally along the line 9—9 in FIG. 8, with the parts shown in the locked position.

Referring to FIG. 9, it should be appreciated that when the locking sleeve 40 is set into the locked position, inner surfaces 46, 47 of locking sleeve end 42 are dimensioned to matingly couple around walls 105, 106, respectively of base portion 101 of rotatable shaft 100 which is powered by rotor shaft 25. Similarly, external surfaces 48, 49 of locking sleeve end 42 are dimensioned to matingly engage with inner surfaces 84, 85 of sleeve guide 80. Given that sleeve guide 80 is restrained against rotation by the engagement of projection 83 and opening 27 of housing portion 20, clamp nut 60, sleeve guide 80 and locking sleeve 40 cooperate to coaxially matingly engage around rotatable shaft 100 and prevent its rotation.

Once the rotatable shaft 100 is locked against rotation by the locking sleeve 40, a power tool user can safely and easily remove the interchangeable accessory tool (not shown) locked by nut 130 in opening 115 which is defined by jaw portions 112. To do this, the user need only hold the housing portion 20 and/or clamp nut 60 of power tool 10 in one hand while using the other 'free' hand to rotate nut 130 in the counterclockwise (or loosening) direction which will ultimately allow jaw portions 112 to release their grip on the shaft of the interchangeable accessory tool. Of course, if the nut is too tight, the user can instead use a wrench tool, applied by his free hand to facilitate loosening of the nut 130.

Since the rotatable shaft 100 is locked against rotation by coupling it to the housing portion 20 by the cooperation of the clamp nut 60, sleeve guide 80 and locking sleeve 40 therewith, a third hand (such as a vise) is not necessary to prevent rotation of shaft 100 relative to the power tool's housing portion 20.

In the preferred embodiment, the power tool 10 has been described as an air tool, however, it should be readily apparent that the present invention is equally applicable to other types of power tools, including electrically driven power tools. While the power transmitting components of other power tools may differ, the collet lock arrangement 30 described above in connection with the preferred embodiment can easily be modified to be incorporated into such other types of power tools.

It is also envisioned that the collet lock arrangement can be used with collet designs that may be different from the jaw portions 112 and nut 130 combination in the preferred embodiment.

It is also envisioned that while the mating engagement of the sleeve guide 80, locking sleeve 40 and base portion 101 of rotatable shaft 100 has been accomplished by providing a substantially square-shaped polygonal arrangement, any type of polygonal arrangement which achieves the same result is equally applicable.

Similarly, while the locking sleeve 40 of the presently preferred embodiment is described as comprising three integral sections, namely, locking sleeve ends 41, 42 and mid-portion 43, any coaxially coupled locking sleeve which locks the rotatable shaft of a power tool 10 by axial movement relative thereto is considered an equivalent to the preferred embodiment.

It should also be readily apparent that whatever interchangeable accessory tool (not shown) is to be used with the power tool 10 of the present invention, once the rotatable shaft 100 is locked against rotation by the engagement of locking sleeve 40 therewith, the power tool can be used manually as a screw driver, with a suitable bit, to facilitate tightening of a screw element by the accessory tool to a specific tactile torque level, or alternatively, to facilitate an initial loosening of the screw element.

The simple construction of the collet lock arrangement 30 of the present invention will inevitably result in economical production with the ultimate effect of low retail costs per unit.

Additionally, because accessory tools can be more readily interchanged using only two hands, productive use of the power tool is greatly increased. Similarly, risk of injury by users who attempt to remove an accessory tool coupled to a non-lockable rotatable shaft and who do not have a 'third' hand and thus occasionally drop the power tool causing injury to themselves and/or to the tool itself, is greatly reduced.

Finally, because the locking sleeve 40 is of such construction as to make removal thereof possible, a user can conveniently replace a damaged or deformed locking sleeve with very little difficulty.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A collet lock arrangement for a power tool having a housing, said collet lock arrangement comprising:

a powered rotatable shaft including a base portion and a distal end portion defining a collet for adaptably connecting a tool attachment thereto; and a locking structure for securely locking said shaft to said housing to selectively prevent said shaft from rotating when in a locked position while allowing said shaft to freely rotate in an unlocked position;

said locking structure having:

a locking sleeve coaxially coupled around said shaft for axial movement relative thereto between the locked and unlocked positions;

a clamp nut fixedly connectable to said housing; and a sleeve guide non-rotatably coupling said locking sleeve to said clamp nut, each of said clamp nut and said guide having a respective opening for coaxially receiving therethrough said shaft and said locking sleeve, wherein during axial movement of said sleeve from the unlocked position to the locked position, a portion of said sleeve is slidably matingly engaged between the base portion of said shaft and said guide to lock said shaft against rotational movement.

2. The collet lock arrangement of claim 1, wherein a portion of said locking sleeve protruding axially from said clamp nut is serrated to facilitate gripping of said locking sleeve during axial movement thereof.

3. The collet lock arrangement of claim 1, wherein said locking sleeve is substantially cylindrical in shape and includes at least one flexible wall area to facilitate sliding said locking sleeve.

4. The collet lock arrangement of claim 3, wherein said flexible wall includes two axially spaced apart grooves engaging said clamp nut respectively in the locked and unlocked positions to inhibit axial movement of said sleeve from said positions.

5. The collet lock arrangement of claim 1, wherein the portion of said sleeve slidably engaged between the base portion of said shaft and said guide has a polygonally-shaped inner cavity which mates around corresponding polygonal surfaces of said base portion of said shaft, said inner cavity being directed into alignment with said base portion by the guide during axial movement of said sleeve into the locked position.

6. The collet lock arrangement of claim 1, wherein said power tool is an air tool.

7. The collet lock arrangement of claim 1, wherein said power tool is an electrically driven power tool.

8. The collet lock arrangement of claim 6, wherein said power tool is a hand-held power tool.

9. The collet lock arrangement of claim 7, wherein said power tool is a hand-held power tool.

10. A collet lock arrangement for a power tool having a housing, said collet lock arrangement comprising:

a powered rotatable shaft including a distal end portion defining a collet for adaptably connecting a tool attachment thereto; and a locking structure for securely locking said shaft to said housing to selectively prevent said shaft from rotating when in a locked position while allowing said shaft to freely rotate in an unlocked position;

said locking structure having:

a clamp nut fixedly connectable to said housing; and a locking sleeve, including two axially spaced apart grooves, coaxially coupled around said shaft for axial movement relative thereto between the locked and unlocked positions, a first one of said grooves engaging said clamp nut in the locked position while a second of said grooves engaging said clamp nut in the unlocked position to inhibit axial movement of said sleeve from said positions.

11. The collet lock arrangement of claim 10, wherein a portion of said locking sleeve protruding axially from said clamp nut is serrated to facilitate gripping of said locking sleeve during axial movement thereof.

12. The collet lock arrangement of claim 10, wherein said locking sleeve is substantially cylindrical in shape and includes at least one flexible wall area to facilitate sliding said locking sleeve.

13. The collet lock arrangement of claim 10, wherein said power tool is an air tool.

14. The collet lock arrangement of claim 10, wherein said power tool is an electrically driven power tool.

15. The collet lock arrangement of claim 13, wherein said power tool is a hand-held power tool.

16. The collet lock arrangement of claim 14, wherein said power tool is a hand-held power tool.

* * * * *